US006488221B1

(12) United States Patent
McDonald

(10) Patent No.: US 6,488,221 B1
(45) Date of Patent: Dec. 3, 2002

(54) SELF-ALIGNING, SPRING-DISK WATERJET ASSEMBLY

(75) Inventor: Michael C. McDonald, Sumner, WA (US)

(73) Assignee: Maxtec, Inc., Kent, WA (US)

( * ) Notice: Subject to any disclaimer, the term of this patent is extended or adjusted under 35 U.S.C. 154(b) by 0 days.

(21) Appl. No.: 09/866,350

(22) Filed: May 25, 2001

(51) Int. Cl.[7] ..... B05B 1/00

(52) U.S. Cl. ..... 239/596; 239/601; 239/602; 239/533.13; 239/533.14; 239/589

(58) Field of Search ..... 239/533.13, 533.14, 239/596, 589, 601, 602, DIG. 4, DIG. 8, DIG. 19

(56) References Cited

U.S. PATENT DOCUMENTS 3,705,693 A * 12/1972 Franz ..... 239/602
3,756,106 A * 9/1973 Chadwick et al. ..... 239/601
4,150,794 A * 4/1979 Higgins ..... 239/596
4,162,763 A 7/1979 Higgins
4,660,773 A 4/1987 O'Hanlon
4,836,455 A 6/1989 Munoz
4,936,512 A 6/1990 Tremoulet, Jr.
5,018,670 A 5/1991 Chalmers
5,199,640 A * 4/1993 Ursic ..... 239/596
5,730,358 A * 3/1998 Raghavan et al. ..... 239/596
5,848,753 A 12/1998 Wands, et al.

* cited by examiner

*Primary Examiner*—Robin O. Evans
(74) *Attorney, Agent, or Firm*—R. Reams Goodloe, Jr.

(57) ABSTRACT

A spring disk with a concentric through bore and a concentric counter bore of specific depth used to hold an orifice against a lapped surface of a nozzle cap in a waterjet assembly. Dimensions are chosen to provide adequate restraint without the need to force the orifice onto the spring disk. When orifice, spring disk and the retaining cap are assembled and the cap is tightened on the inlet nozzle, the spring disk is forced to the cap surface and the orifice becomes securely held and centrally aligned within the assembly.

19 Claims, 3 Drawing Sheets

SELF-ALIGNING, SPRING-DISK WATERJET ASSEMBLY

CROSS REFERENCE TO RELATED APPLICATIONS

Patent, Issued, Inventor(s), Applicant(s), Title: U.S. Pat. No. 41 50794, Apr. 19, 1979, Higgins, Camsco, Inc., Liquid jet cutting nozzle and housing; U.S. Pat. No. 4162763, Jul. 7, 1979, Higgins, Camsco, Inc., Waterjet valve assembly; U.S. Pat. No. 4,660,773, Apr. 4, 1987, O'Hanlon, Flow Industries, Inc., Leakproof high pressure nozzle assembly; U.S. Pat. No. 4,836,455, Jun. 19 1989, Munoz, Ingersoll-Rand Company, Fluid-jet-cutting nozzle assembly; U.S. Pat. No. 4,936,512, Jun. 19, 1990, Tremoulet, Jr., Flow International Corporation, Nozzle assembly and method of providing same; U.S. Pat. No. 5,996,40, Apr. 19, 1993, Ursi, Shock mounted high pressure fluid jet orifice assembly and method of mounting fluid jet orifice member; U.S. Pat. No. 5,848, 753, Dec. 19, 1998, Wands & Scott, Ingersoll-Rand Company, Waterjet orifice assembly.

BACKGROUND OF INVENTION

The invention relates generally to high-pressure fluid jet nozzles and more particularly to an orifice jet nozzle assembly for waterjet cutting systems and the like that use high-pressure fluids to form a high-energy stream for solid material cutting and similar processes. The proper alignment of the orifice that forms the water stream is essential to proper function and accurate cutting. The orifice must also be replaced at frequent intervals. The process of orifice installation and alignment takes time and cannot be done by machine operators under field conditions. Furthermore, all current waterjet systems allow for only a single orifice per nozzle. The foregoing illustrates limitations known to exist in present devices and methods. Thus, it is apparent that it would be advantageous to provide a means that allows for easy installation and alignment of orifices by operating waterjet system personnel, and allows for multiple orifices from a single nozzle that allow multiple waterjet streams. Accordingly, a suitable method is provided that allows easy replacement and alignment of orifices by field personnel, and allows multiple orifices in a single nozzle. The assembly can also be used to maintain consistent alignment with a down stream mixing tube, such as used in abrasive waterjet cutting.

SUMMARY OF INVENTION

The invention uses a spring disk to retain and align an orifice(s) on a smooth flat surface. The spring disk has a large outside diameter, one or more through-holes in area of center of its surface, and, concentric with the through-holes, shallow recesses (or counterbores). The wells are slightly larger in diameter than the particular orifice to be mounted and slightly shallower than the thickness of the orifice. The orifice(s) is (are) placed into the recesses (counterbores). When installing an orifice, a small amount of a viscous liquid, such as water with soap, will prevent the orifice(s) from falling out of the recess(es). The nozzle cap is made with a recess (counterbore) that has a diameter that is slightly larger than the spring disk and has through-holes that are concentric with the orifice hole. The recessed surface of the cap is lapped so that it is very flat and smooth. The diameter of the spring disk is larger than the inner diameter of the inlet tube. When the cap is mounted on the Inlet tube and tightened, the outer diameter of the spring disk is forced to flex to the cap surface while the center portion is restrained by the orifice that is resting on the same cap surface. This imposes a force (a preload) on the orifice(s) which acts on the lapped surface of the cap. The force on the orifice(s) is a function of the diameter, thickness and displacement of the outer portion of the spring disk. This force Is not sufficient to prevent fluid from leaking around the orifice. The principle that works to provide total sealing is a self-actuating concept that uses the difference in area between the top of the orifice and the bottom that is resting on the lapped surface. The hole through the cap is larger than the diameter of the bore through the orifice. The inlet area of the orifice (exposed to high pressure fluid) is larger than the area of the orifice resting on the lapped surface. The resulting effect is that the stress acting on the orifice at the lapped surface is much greater than the stress at the inlet area of the orifice. As a result, when the lapped area is smooth, fluid cannot leak past the orifice. In addition, the spring disk may be bored and counterbored to allow placement of several orifices at specified distances from each other to permit multiple waterjets for simultaneous cutting.

DETAILED DESCRIPTION

Figure 1:
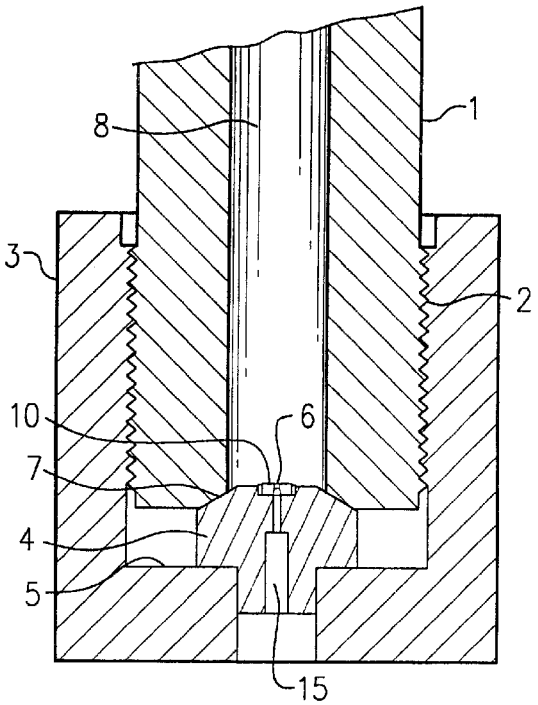
FIG. 1 (PRIOR ART)
FIG. 1 is a cross section of prior art nozzle assembly.

FIG. 1 shows a mounting assembly capable of accepting an orifice. As shown in FIG. 1, a piece of high pressure conveyance tubing, designated by the reference numeral 1, is provided with a threaded end 2, onto which a nozzle cap 3 is screwed to secure and hold in place an orifice system 4 between lands 5 of the nozzle cap and an alignment and seal taper 7 of the tube 1. For cutting solid material, cutting fluid, usually water under high pressures usually above 20,000 psi, is supplied to the interior 8 of the inlet tube 1 and escapes as a focused stream through orifice bore 6. This concentrated fluid jet performs the cutting process on solid materials.

Figure 2:
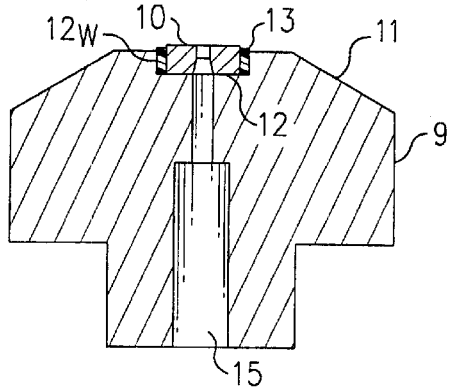
FIG. 2 (PRIOR ART)
FIG. 2 is a cross section of prior art support system for orifice.

FIG. 2 shows a nozzle according to a prior art which might be installed in the nozzle fixture formed by nozzle tube 1 and nozzle cap 3, as shown in FIG. 1. The nozzle is formed of a body portion 9 having an internal bore 15 provided through the center of the body. A complementary seal taper 11 cooperates with the taper surface 4 of tube 1 to align and seal the orifice body 9 in the assembly. A typical orifice 10 is shown mounted in counterbore 12 in the orifice body a polymer seal 13 material is pressed in to the annulus between the orifice 10 outside diameter and the counterbore wall. This retains the orifice. Although generally acceptable, this embodiment of the prior art fails to provide a positive means of securing the nozzle 10 within the orifice body 9. Due to the high operating pressures and sometimes rapid fluctuations in pressure, the orifices frequently become dislodged. In addition, erosion around the orifice has occurred at times thus permitting the orifice to move laterally out of focus or become more easily dislodged from its mounting. In applications using extreme high or low temperature fluids, the polymer seal 13 fails, resulting in orifice failure.

Figure 3:
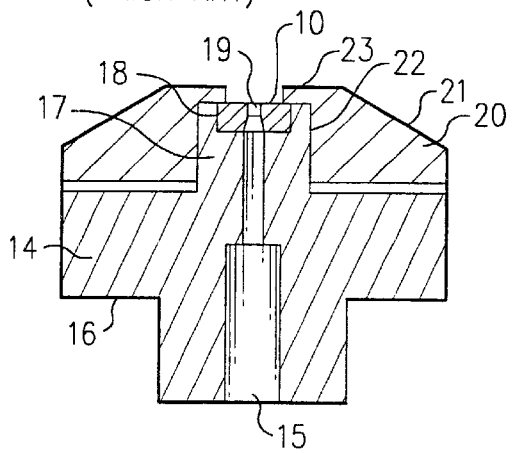
FIG. 3 (PRIOR ART)
FIG. 3 is a cross section of improved prior art method for aligning and confining orifice.

FIG. 3 shows a more recent prior art in which a mounting body 14 is provided with a central through bore 1 5, a mounting flange 16 for mating with lands 5 of nozzle cap 3, and a cylindrical head 17 which is further provided with a counterbore 18 which receives a orifice 10 having an orifice bore 19 which aligns axially along the mounting through bore 15. Also shown is retaining hat 20 with a conical surface 2l and a cylindrical bore 22, which cooperates with cylindrical head 14 by means of an interference fit to secure the conical hat 20 on the head 17. The conical hat 20 is further provided with an internal flange 23 which presses on and secures the orifice 10 in the bore 18 of the head 14. This prior art secures the orifice in place and provides alignment for the jet stream. While the prior art provides for a positive system for securing the orifice, it is a complex and expensive design that requires special tools and does not allow for replacement of the orifice by field personnel. According to the present invention, the orifice supporting system is much simpler, is easily aligned, and allows the orifice to be replaced by operating field personnel; no special tools or training are required. This results in much lower orifice replacement costs and reduces the waterjet cutting system down time.

Figure 4:
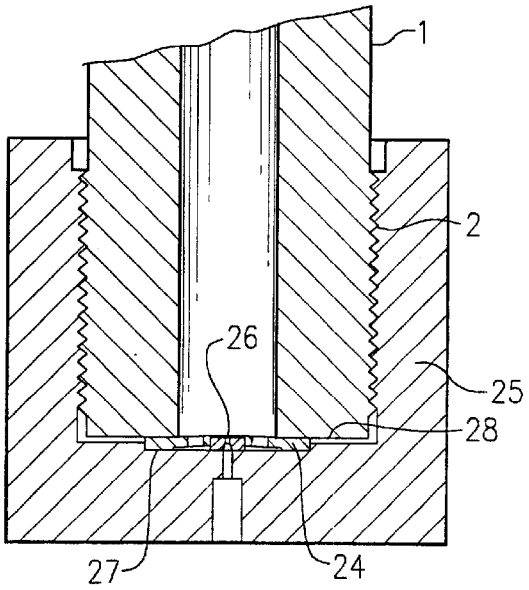
FIG. 4 is a cross section of nozzle assembly for use with the present invention.

FIGS. 4, 5, 6, 7, and 8 refer to the present invention. FIG. 4 shows a waterjet assembly capable of accepting a orifice. A piece of high pressure tubing, designated by the reference numeral 1, is provided with a threaded end 2, onto which a nozzle cap 25 is screwed to secure a spring disk 24 between lapped surface 27 of the nozzle cap and the end of the nozzle tube 28. The spring disk is designed to confine and concentrically align orifice(s) 26 with the throughbore of the spring disk and the nozzle cap.

Figure 5:
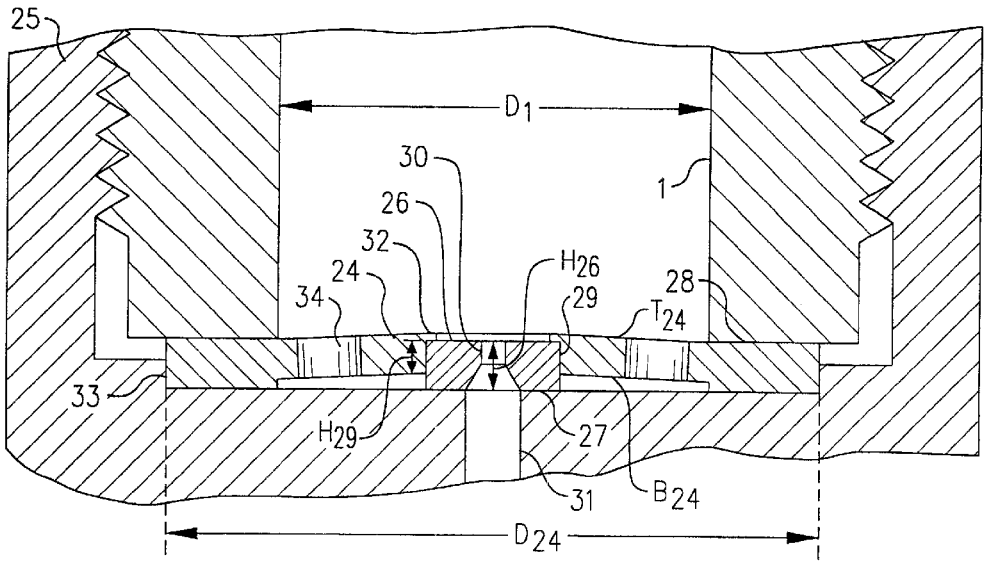
FIG. 5 is a cross section of nozzle cap, inlet tube, spring disk and orifice for use with the present invention.

FIG. 5 shows spring disk 24 with a thickness slightly smaller than the orifice with a recess (counterbore) 29 that receives orifice 26 having an orifice bore 30. Recess (counterbore) 30 has a depth that is smaller than the height of the orifice and aligns axially with bore 31 of the nozzle cap. The orifice is restrained by a flange 32 of the spring disk. The nozzle cap 25 is made with a recess (counterbore) 33 that has a height that is smaller than the spring disk, a diameter that is slightly larger than the spring disk, and throughhole(s) 31 that is (are) concentric with the orifice hole 30. The recessed surface 27 of the nozzle cap is lapped so that the surface is flat and smooth.

The diameter of the spring disk 24 is slightly larger than the diameter of the inlet tube 1. When the nozzle cap 25 is mounted on the inlet tube 1 and tightened, the outer diameter of the spring disk 24 is forced to flex to the nozzle cap surface 27 while the center portion is restrained by the orifice 24 held In place by flange 32 and rests on the lapped surface 27 of the nozzle cap 25. This secures and aligns the orifice and prevents the possibility of movement or escape of orifice 26. The center portion of the spring disk 24 may contain thru bore(s) 34. The thru bore(s) prevent pressure imbalances from occurring between the top and bottom of the spring disk 24 that could cause over flexing and failure of the spring disk 24. The thru bore(s) are located in the annulus between the bore of the inlet tube 1 and the recess 29.

Figure 6:
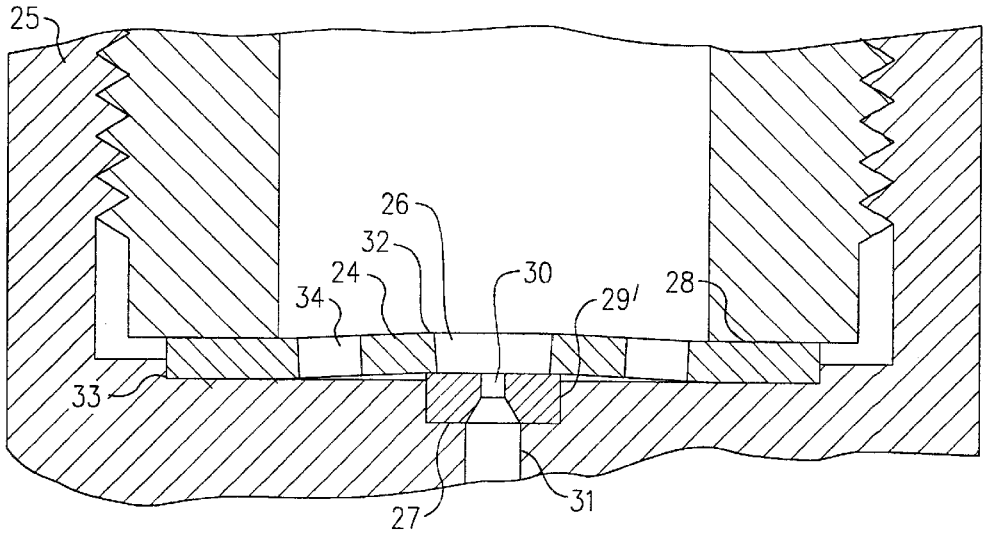
FIG. 6 is a cross section of an alternate configuration employing the spring disk.

FIG. 6 shows an alternate configuration of the assembly shown in FIG. 5 where the recess 29 is located in the nozzle cap 25.

Figure 7:
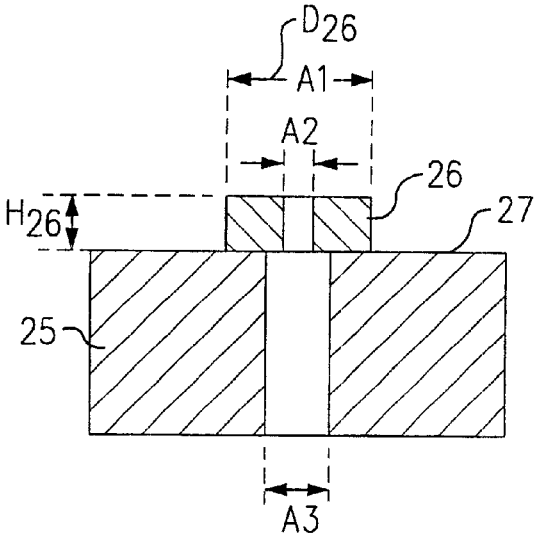
FIG. 7 is a cross section of orifice and nozzle cap for use with the present invention showing principle of difference in high pressure area that prevents leakage around the orifice.

FIG. 7 shows the principle that works to provide total sealing. It is a self-actuating concept that uses the difference in areas between the top and bottom surfaces of the orifice 26. Since the stress (pressure) that is acting on each surface is the same, the force acting on the larger area on top of the orifice (A1–A2) is much larger than the force acting on the area of the surface in contact with the nozzle cap (A1–A3). As a result, when the nozzle cap surface 27 is lapped and smooth, fluid cannot leak past the orifice. According to the present invention, it has been found that suitable material for the spring disk are a number of metals having a degree of corrosion resistance and adequate flexibility to assure proper restraint of the orifice without fracturing it. Having described the present invention in terms of preferred embodiments, we do not wish to be limited in the scope of our invention except as claimed.

Figure 8:
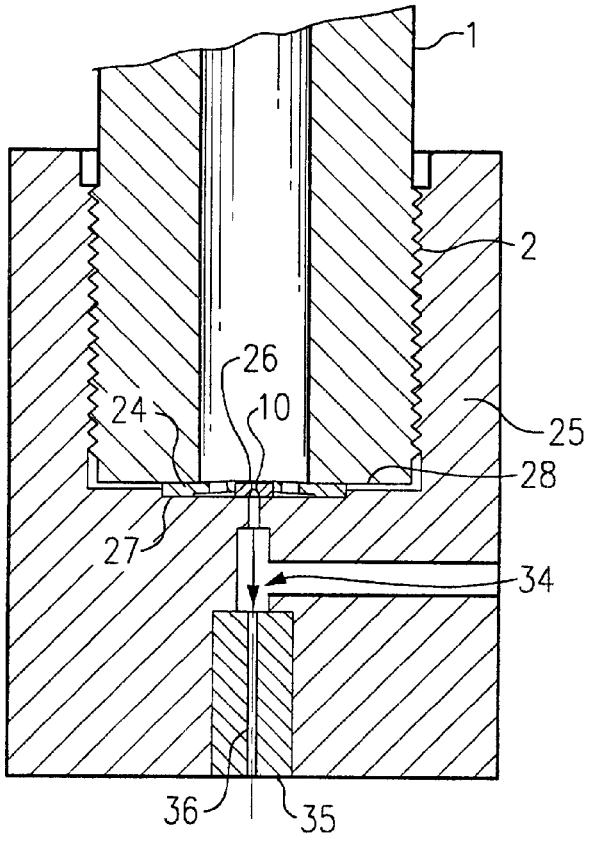
FIG. 8 is a cross section of a typical abrasive Waterjet nozzle using the spring disk.

FIG. 8 is a cross section of a typical abrasive waterjet nozzle. An extension is added to the nozzle cap 25. Abrasive media flows into a feed port 34 and a mixing tube 35 in located concentric with the through bore of the orifice 10. The abrasive media is entrained and accelerated in the mixing tube to very high velocities for cutting and cleaning. Alignment of the waterjet stream is very critical to prevent rapid erosion of the mixing tube bore 36.

What is claimed is:

1. A waterjet orifice assembly comprising:

(a) a high pressure tubing having a central bore and a threaded end;

(b) a nozzle cap, said nozzle cap having threads sized and shaped for complementary mating engagement with said threaded end of said high pressure tubing, said nozzle cap having an outlet bore, and, adjacent said nozzle cap outlet bore, an interior orifice receiving surface;

(c) a spring disk, said spring disk having an overall diameter larger than the diameter of said central bore in said high pressure tubing, said spring disk further comprising a counterbore of preselected height, said counterbore further comprising a flange portion;

(d) at least one orifice, said at least one orifice having a central bore sized and shaped for escapement of high pressure fluid therethrough, said at least one orifice having a height at least slightly larger than said preselected height of said counterbore of said spring disk, said at least one orifice removably mounted in said counterbore of said spring disk; and (e) wherein said spring disk is clamped between said nozzle cap and said high pressure tubing, so as to force said at least one orifice downward against said interior orifice receiving surface of said nozzle cap.

2. The apparatus as set forth in claim 1, wherein a single orifice is provided, and wherein said outlet bore of said nozzle cap is concentric with said central bore of said high pressure tubing.

3. The apparatus as set forth in claim 1, wherein a single orifice is provided, and wherein said counterbore of said spring disk is concentric with said central bore of said high pressure tubing.

4. The apparatus as set forth in claim 1, wherein said spring disk is sufficiently flexible so as to prevent the crushing of said orifice when said nozzle cap is tightened to secure said nozzle cap to said high pressure tubing.

5. The apparatus as set forth in claim 1, wherein said orifice has an inlet side having an inlet side area, and an outlet size having an outlet side land area which sits against said interior orifice receiving surface of said nozzle cap, and wherein hydrostatic pressure is contained within said high pressure tubing and transmitted to said inlet side area of said orifice, and wherein such force is transmitted through said orifice to said outlet side land area of said orifice, and wherein said inlet side area is larger than said outlet side land area of said orifice, so that sealing of said orifice against said interior orifice receiving surface of said nozzle cap is achieved.

6. The apparatus as set forth in claim 1, wherein said interior orifice receiving surface of said nozzle cap comprises a lapped surface.

7. The apparatus as set forth in claim 5, wherein said interior orifice receiving surface of said nozzle cap comprises a lapped surface.

8. The apparatus as set forth in claim 1, wherein said spring disk comprises a plurality of counterbores, and wherein an orifice is provided in secure mounted engagement in each one of said plurality of counterbores.

9. The apparatus as set forth in claim 1, wherein said spring disk is removably replaceable.

10. The apparatus as set forth in claim 1, wherein said orifice is removably replaceable.

11. A waterjet orifice assembly comprising:

(a) a high pressure tubing having a central bore and a threaded end;

(b) a nozzle cap, said nozzle cap having threads sized and shaped for complementary mating engagement with said threaded end of said high pressure tubing, said nozzle cap having an outlet bore, and, adjacent said nozzle cap outlet bore, an interior counterbore having an orifice receiving surface;

(c) a spring disk, said spring disk having an overall diameter larger than the diameter of said central bore in said high pressure tubing, said spring disk further comprising a centrally located bore for passage of high pressure fluid therethrough;

(d) an orifice, said orifice having a central bore sized and shaped for escapement of high pressure fluid therethrough, said orifice having a height at least slightly larger than said preselected height of said interior counterbore of said nozzle cap, said orifice removably mounted in said interior counterbore of said nozzle cap; and (e) wherein said spring disk is clamped between said nozzle cap and said high pressure tubing, so as to force said orifice downward against said orifice receiving surface of said interior counterbore of said nozzle cap.

12. The apparatus as set forth in claim 11, wherein a single orifice is provided, and wherein said outlet bore of said nozzle cap is concentric with said central bore of said high pressure tubing.

13. The apparatus as set forth in claim 11, wherein said spring disk is sufficiently flexible so as to prevent the crushing of said orifice when said nozzle cap is tightened to secure said nozzle cap to said high pressure tubing.

14. The apparatus as set forth in claim 11, wherein said orifice has an inlet side having an inlet side area, and an outlet size having an outlet side land area which sits against said orifice receiving surface of said nozzle cap, and wherein hydrostatic pressure is contained within said high pressure tubing and transmitted to said inlet side area of said orifice, and wherein such force is transmitted through said orifice to said outlet side land area of said orifice, and wherein said inlet side area is larger than said outlet side land area of said orifice, so that sealing of said orifice against said orifice receiving surface of said nozzle cap is achieved.

15. The apparatus as set forth in claim 11, wherein said orifice receiving surface of said nozzle cap comprises a lapped surface.

16. The apparatus as set forth in claim 11, wherein said orifice receiving surface of said nozzle cap comprises a lapped surface.

17. The apparatus as set forth in claim 11, wherein (a) said spring disk comprises a plurality of counterbores, and wherein an orifice is provided in secure mounted engagement in each one of said plurality of counterbores, and (b) said nozzle cap comprises a plurality of outlet bores.

18. The apparatus as set forth in claim 11, wherein said spring disk is removably replaceable.

19. The apparatus as set forth in claim 11, wherein said orifice is removably replaceable.

* * * * *